US009795892B2

(12) United States Patent
Silverglate et al.

(10) Patent No.: US 9,795,892 B2
(45) Date of Patent: Oct. 24, 2017

(54) TOY CAR APPARATUS

(71) Applicant: Thoughtfull Toys, Inc., Santa Cruz, CA (US)

(72) Inventors: David E. Silverglate, Santa Cruz, CA (US); Brian Gulassa, Berkeley, CA (US); Steven Asher Silverglate, Santa Cruz, CA (US)

(73) Assignee: Thoughtfull Toys, Inc., Santa Cruz, CA (US)

( * ) Notice: Subject to any disclaimer, the term of this patent is extended or adjusted under 35 U.S.C. 154(b) by 4 days.

(21) Appl. No.: 14/503,237

(22) Filed: Sep. 30, 2014

(65) Prior Publication Data

US 2015/0093962 A1 Apr. 2, 2015

Related U.S. Application Data

(60) Provisional application No. 61/884,829, filed on Sep. 30, 2013, provisional application No. 61/901,946, filed on Nov. 8, 2013.

(51) Int. Cl.

| | |
|---|---|
| ***A63H 17/26*** | (2006.01) |
| ***A63H 17/38*** | (2006.01) |
| ***A63H 17/00*** | (2006.01) |

(52) U.S. Cl.

CPC ..... *A63H 17/38* (2013.01); *A63H 17/002* (2013.01); *A63H 17/26* (2013.01); *A63H 17/262* (2013.01); *Y10T 29/49826* (2015.01); *Y10T 29/53* (2015.01)

(58) Field of Classification Search

CPC ..... A63H 17/00; A63H 17/262; A63H 17/38

See application file for complete search history.

(56) References Cited

U.S. PATENT DOCUMENTS

| | | | | |
|---|---|---|---|---|
| 1,547,516 A * | 7/1925 | Neff | ..... | A63H 19/16 180/89.1 |
| 2,888,778 A * | 6/1959 | Carter | ..... | A63H 17/38 280/89.11 |
| 3,144,731 A * | 8/1964 | Baxter | ..... | A63H 17/38 446/466 |
| 5,449,311 A | 9/1995 | Williams | | |
| 6,026,923 A | 2/2000 | Uphaus | | |

(Continued)

OTHER PUBLICATIONS

ISA United States Patent and Trademark Office, International Search Report and Written Opinion of PCT/US2014/058487, Jan. 7, 2015, 10 pages.

*Primary Examiner* — Gene Kim
*Assistant Examiner* — Alyssa Hylinski
(74) *Attorney, Agent, or Firm* — Alleman Hall Creasman & Tuttle LLP

(57) ABSTRACT

A family of toy cars includes a plurality of components, which cooperatively translate a motive force applied to a finger engagement structure into motion of the toy car in a horizontal plane. The toy car system includes a chassis, a body, a finger engagement structure, a pair of front wheels rotatably coupled to the chassis, and a pair of rear wheels rotatably coupled to the chassis. Each of the front pair of wheels may be coupled to the front suspension by a castered coupling. The toy car may include a steering linkage between the front wheels configured such that the front wheels turn in unison in response to the motive force applied to the toy car.

19 Claims, 14 Drawing Sheets

(56) References Cited

U.S. PATENT DOCUMENTS

| | | | | |
|---|---|---|---|---|
| 6,371,828 | B1 * | 4/2002 | Ngan | A63H 17/16 446/327 |
| 6,599,129 | B2 | 7/2003 | Jenkins et al. | |
| 7,059,661 | B2 | 6/2006 | Mataja et al. | |
| 7,931,519 | B2 * | 4/2011 | Fox | A63H 17/25 280/87.042 |
| 2002/0077025 | A1 * | 6/2002 | Wu | A63H 17/262 446/465 |
| 2005/0079793 | A1 * | 4/2005 | Ogihara | A63H 30/04 446/456 |
| 2005/0140109 | A1 * | 6/2005 | Yamaguchi | A63H 17/262 280/93.512 |
| 2007/0202773 | A1 | 8/2007 | Yuen | |
| 2008/0303227 | A1 * | 12/2008 | Chi Chun Idiot | A63H 17/262 280/1 |
| 2011/0177755 | A1 * | 7/2011 | Nakayama | A63H 17/262 446/470 |
| 2012/0094574 | A1 * | 4/2012 | Grisolia | A63H 17/262 446/437 |

* cited by examiner

TOY CAR APPARATUS

CROSS-REFERENCE TO RELATED APPLICATIONS

This application claims the benefit of U.S. Provisional Patent Application No. 61/884,829, filed Sep. 30, 2013, and entitled "Toy Car Apparatus," and also claims the benefit of U.S. Provisional Patent Application No. 61/901,946, filed Nov. 8, 2013, and entitled "Toy Car Apparatus," the complete contents of which are hereby incorporated herein by reference for all purposes.

BACKGROUND

Children love toy cars. The available modes of play of current toy cars available to children are limited. For example, many toy cars are not engineered to be steerable. Thus, a child may only move the car in straight lines. Additionally, toy cars that are engineered to be steerable make use of a small steering wheel that is difficult for the child to actuate and subject to mechanical failure due to stresses upon the steering wheel during normal play.

A second type of toy cars available to children are model cars that may be assembled by the child. These cars are scale models of existing car designs assembled with plastic or rubber cement. Thus, the assembled model car is limited to few, if any, play modes other than display, due to the fixed assembly of the model car.

SUMMARY

A family of toy cars scaled to receive a force from a user's hand is provided. Each toy car may include a plurality of components, which cooperatively translate a force applied to a finger engagement structure within the toy car into motion of the toy car in a horizontal plane. The toy car components may include a body, a finger engagement structure, a front suspension and a rear suspension, each coupled to the chassis. A pair of rear wheels may be rotatably coupled to the rear suspension. A front pair of front wheels be coupled to the front suspension via a respective castered coupling. The pair of front wheels may also be linked by a steering linkage configured such that the front wheels turn in unison in response to a steering force applied to the toy car.

In a first aspect, a toy car scaled to receive a force from a user's hand, the toy car includes a chassis, a finger engagement structure coupled to the chassis, a pair of rear wheels rotatably coupled to the chassis, a pair of front wheels rotatably coupled to the chassis via a castered coupling is disclosed. The front wheels may be turnable and linked by a steering linkage configured such that the front wheels turn in unison in response to a motive force applied to the toy car. Further, the chassis, the pair of front wheels, the pair of rear wheels, and the steering linkage are configured to cooperatively translate the motive force applied at the finger engagement structure to motion of the toy car.

In this first aspect, the castered coupling is configured to provide each front wheel with a positive caster angle, the positive caster angle providing a force on each of the front wheels toward a neutral steering angle.

The finger engagement structure may include a finger receiving well positioned in a central region of the chassis of the toy car, longitudinally and laterally intermediate the front and rear wheels. The finger receiving well may also be substantially centered in a lateral dimension between right side wheels and left side wheels of the toy car and substantially centered in a longitudinal dimension relative to the front and rear wheels. The finger receiving well may also be positioned at a height that is at or below a top side of the chassis. Alternatively, the finger receiving well may be positioned at a height that is at or below a top side of a largest diameter wheel among the front and rear wheels. As third alternative, the finger receiving well may be positioned at a height that is at or above a height of the axis of rotation of a lowest one of the front and rear wheels. In all configurations of this first aspect, at least a portion of the finger receiving well may be configured to be symmetrical about a substantially vertical axis.

In this first aspect, the finger engagement structure may be formed in the shape of a seat mounted in a central region of the chassis as viewed from above.

An advantage of the configuration of the finger engagement structure of this first aspect is the chassis may not include a steering wheel configured to steer the front wheels. The turning of the car is effected by the actuation of a user's finger in a finger receiving well of a finger engagement structure coupled to the chassis.

Other features of this first aspect include the chassis and a plurality of external body components form a body contour when assembled. The body contour may provide a surface to grip the toy car with opposing fingers. Further, body contour may be located substantially centered in a longitudinal dimension relative to the front and rear wheels.

This first aspect of the toy car may include a body shaped in the form of one of a street car, track car, or dirt car.

Additional features of this first aspect may include a front suspension component and a rear suspension component including springs configured to absorb a vertical force applied to the toy car. Additionally, the front suspension component may be further configured to provide a maximum turning radius in a range from 25-30 degrees to the front wheels.

Also in this first aspect, the pair of front wheels and the pair of rear wheels may each include a tire, where a profile of the tire is configured to be one of rounded, intermediately rounded, or flat.

In a second aspect, a toy car including a chassis, a pair of rear wheels rotatably coupled to the chassis, a pair of front wheels coupled via a castered coupling to the chassis is disclosed. The front wheels may be turnable and linked by a steering linkage configured such that the front wheels turn in unison in response to a motive force applied to the toy car. The second aspect may also include a front suspension component including springs, where the springs are configured to cushion a vertical force applied to the toy car. The front suspension component may also be further configured to provide a maximum turning radius in a range of 25-30 degrees to the front wheels.

The second aspect may also include a rear suspension component including springs configured to cushion a vertical force applied to the toy car, and a removable seat and seat pan coupled to the chassis where the removable seat configured to receive a finger and receive the motive force applied at the seat of the toy car. In this second aspect, the chassis, the front suspension, rear suspension, the pair of front wheels, the pair of rear wheels, and the steering linkage are configured to cooperatively translate the motive force applied to the seat to motion of the toy car in a horizontal plane.

A third aspect of this disclosure includes a toy car including a chassis, a pair of rear wheels rotatably coupled to the chassis, a pair of front wheels, each of the pair of front wheels coupled via a castered coupling to the chassis where the front wheels may be turnable and may be linked by a steering linkage configured such that the front wheels turn in unison in response to a motive force applied to the toy car.

This third aspect may also include a front suspension component including springs configured to cushion a vertical force applied to the toy car. The front suspension may also be further configured to provide a maximum turning radius in a range of 25-30 degrees to the front wheels.

This third aspect may also include a rear suspension component including springs configured to cushion a vertical force applied to the toy car.

Additional features of this third aspect include a removable seat and seat pan coupled to the chassis configured to receive a finger and translate the motive force applied at the seat to motion of the toy car and a plurality of external body components, where the chassis and the plurality of external body components form a body contour centered longitudinally between the front and rear wheels. This body contour may be sized to be gripped by a hand of a user and providing a surface to grip the toy car with opposing fingers.

In this third aspect, the chassis, the front suspension, rear suspension, the pair of front wheels, the pair of rear wheels, and the steering linkage may be configured to cooperatively translate the motive force applied to the body contour to motion of the toy car in a horizontal plane.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 11:
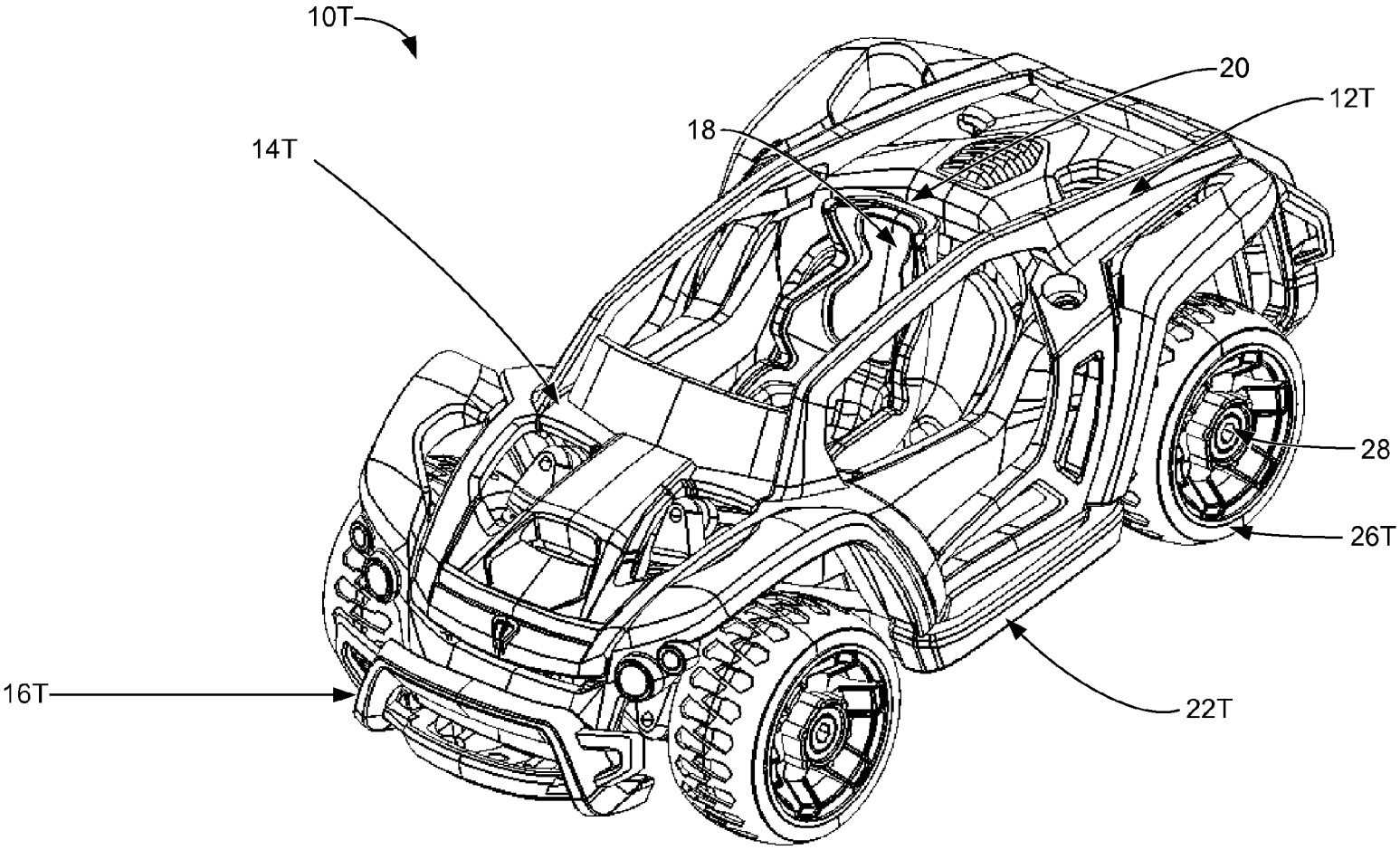
FIG. 11 is an orthogonal view of a second embodiment of a toy car.
Figure 12:
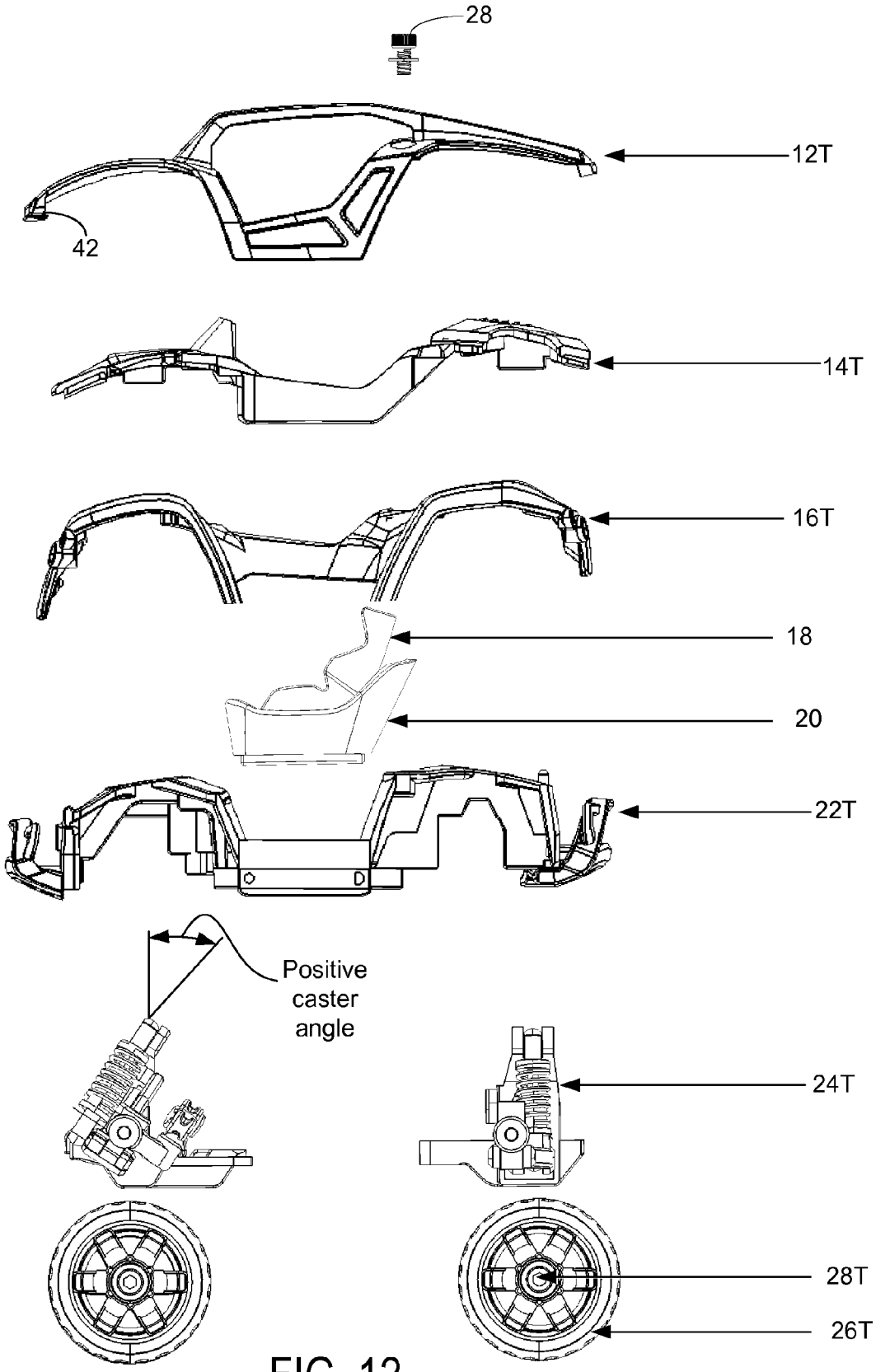
FIG. 12 is an exploded side view of the toy car of the embodiment of FIG. 11.
Figure 13:
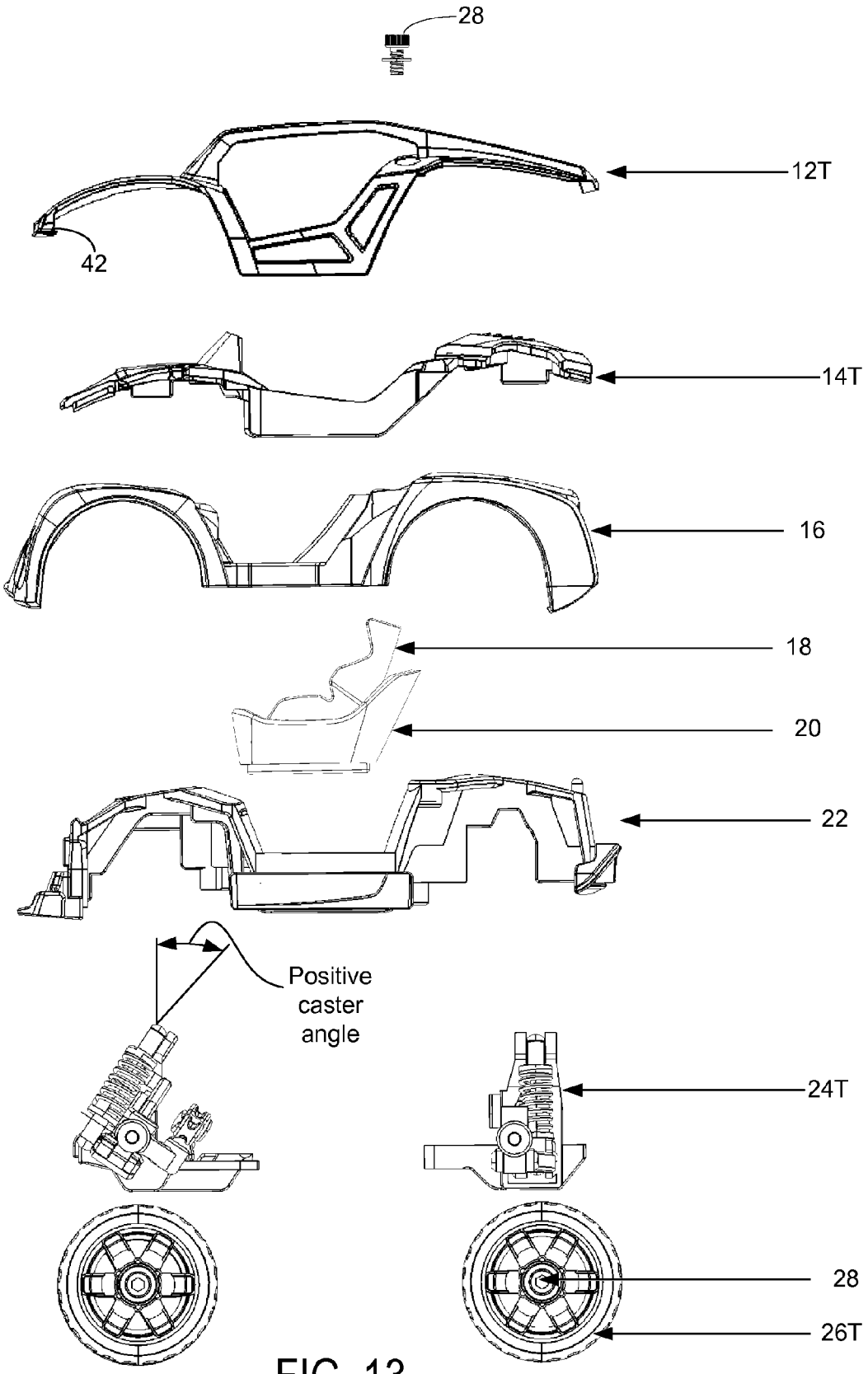
FIG. 13 is an exploded side view of a toy car including components of the toy car of the embodiment of FIG. 1 and components of the toy car of the embodiment of FIG. 11.

Described herein generally is a toy car configured to be driven by a user through engagement of a digit of the user and a finger receiving well positioned in the toy car. The configuration of the suspension and steering systems enable the user to steer the toy car simply by urging the car left and right, without the need for an actual steering wheel on the toy car. FIGS. 1-10 illustrate a first embodiment of the toy car in the shape of a track car. FIGS. 11-12 illustrate a second embodiment of the toy car in the shape of a dirt car. FIG. 13 illustrates a third embodiment of the toy car in the shape of a street car. Features of these various embodiments will now be described with reference to the Figures, as follows.

Figure 4A:
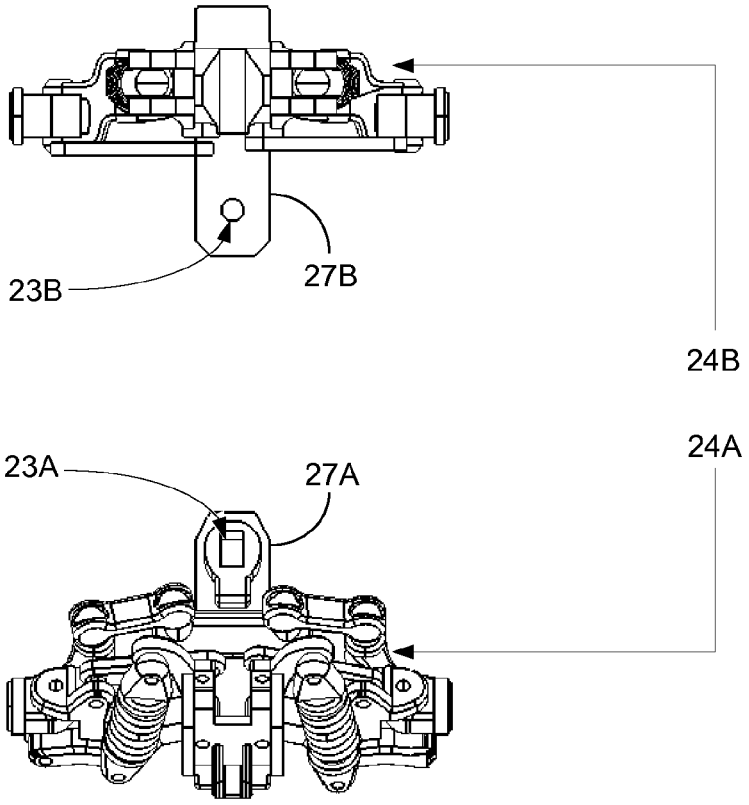
FIG. 4A is a top view of the suspension components of the toy car of the embodiment of FIG. 1.
Figure 4B:
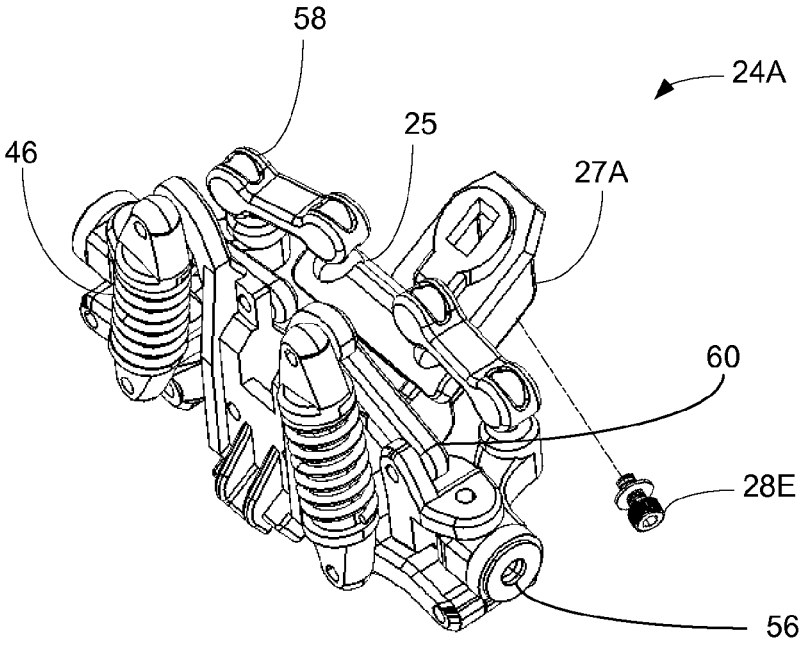
FIG. 4B is an orthogonal view of a front suspension component of the toy car of the embodiment of FIG. 1.
Figure 5:
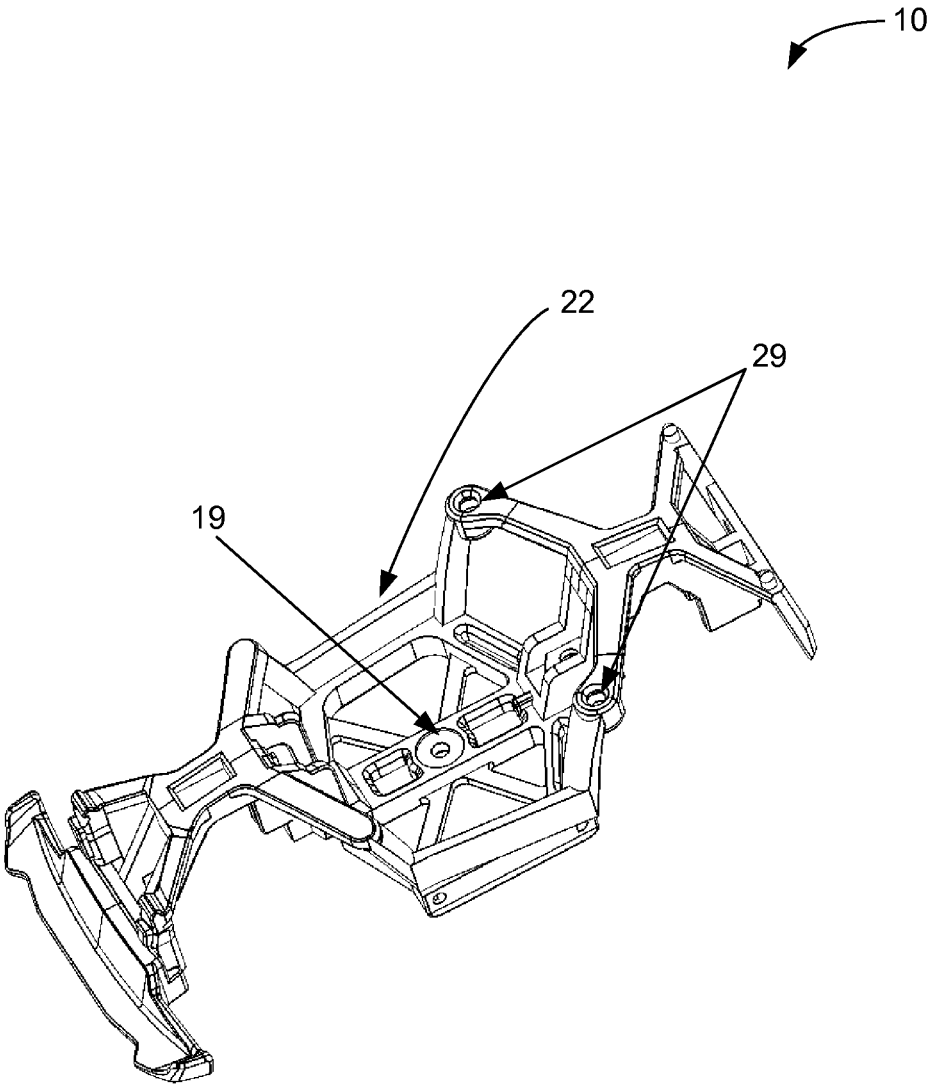
FIG. 5 is an orthogonal view of a chassis of the toy car of the embodiment of FIG. 1.

In FIGS. 1-10 a toy car system 10 according to the first embodiment is generally indicated at 10. As shown in FIG. 5, the toy car system 10 of the first embodiment includes a chassis 22 having fastener receiving holes 29 therein. The fastener receiving holes 29 may be internally threaded. Returning to FIG. 1, the toy car system 10 also includes a plurality of external body components, such as frame 12 of FIG. 8, fender 16, and hood 14 illustrated in FIG. 7. Collectively, when assembled these external body components provide toy car system 10 with a recognizable design shape, in this first embodiment a track car, and further enable multiple play modes which will be discussed in detail below.

Figure 7:
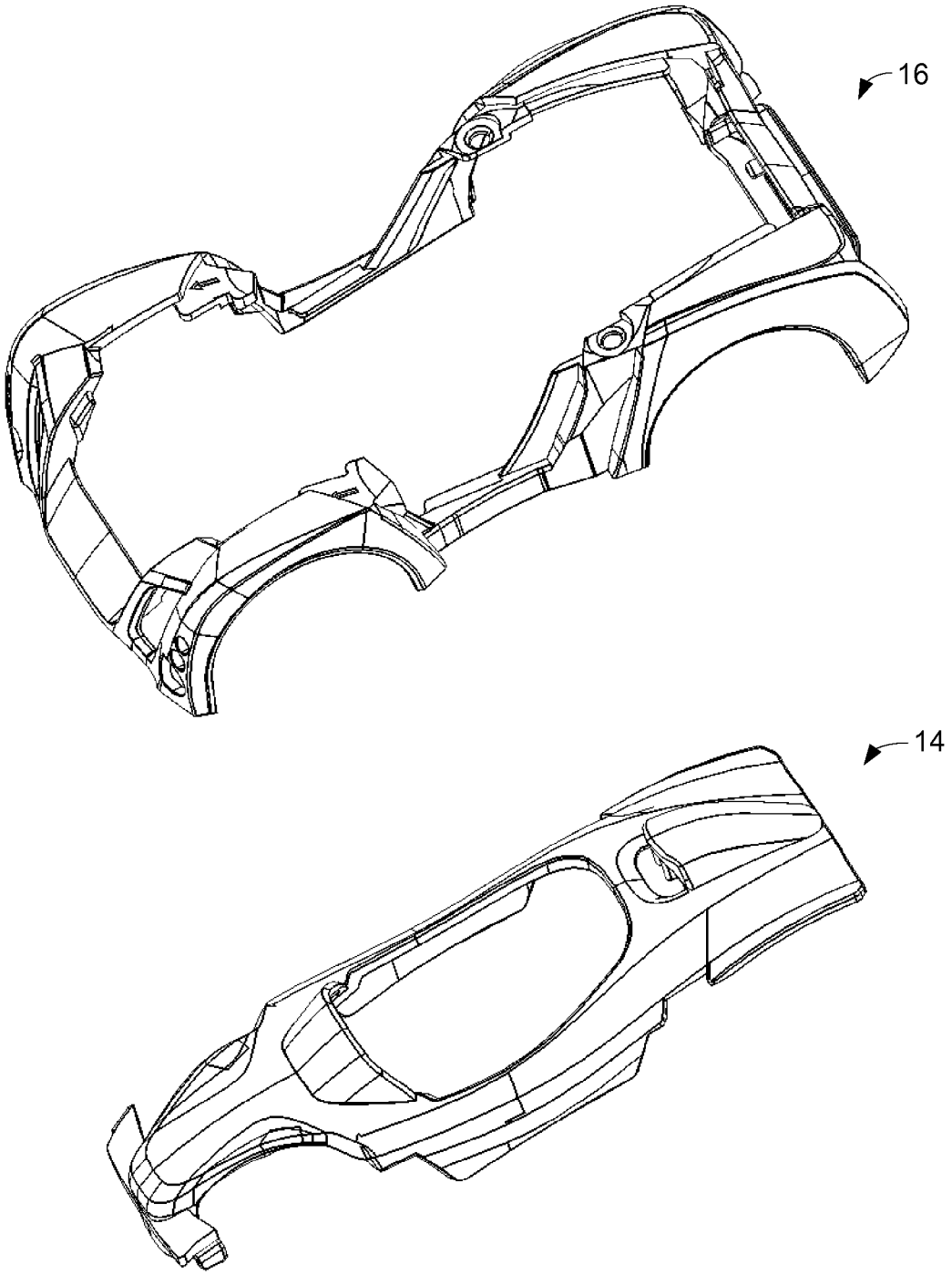
FIG. 7 is an orthogonal view of a body component and a hood of the toy car of the embodiment of FIG. 1.
Figure 8:
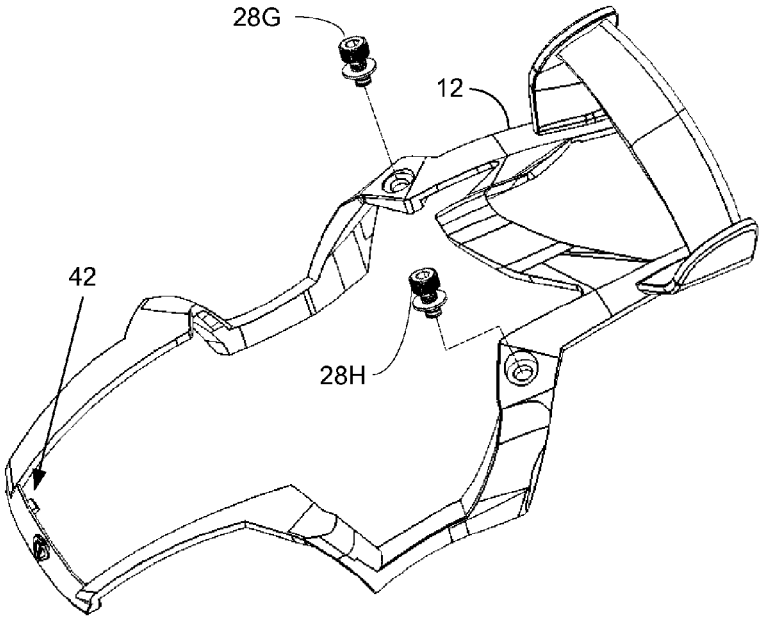
FIG. 8 is orthogonal view of a frame of the toy car of the embodiment of FIG. 1.
Figure 9:
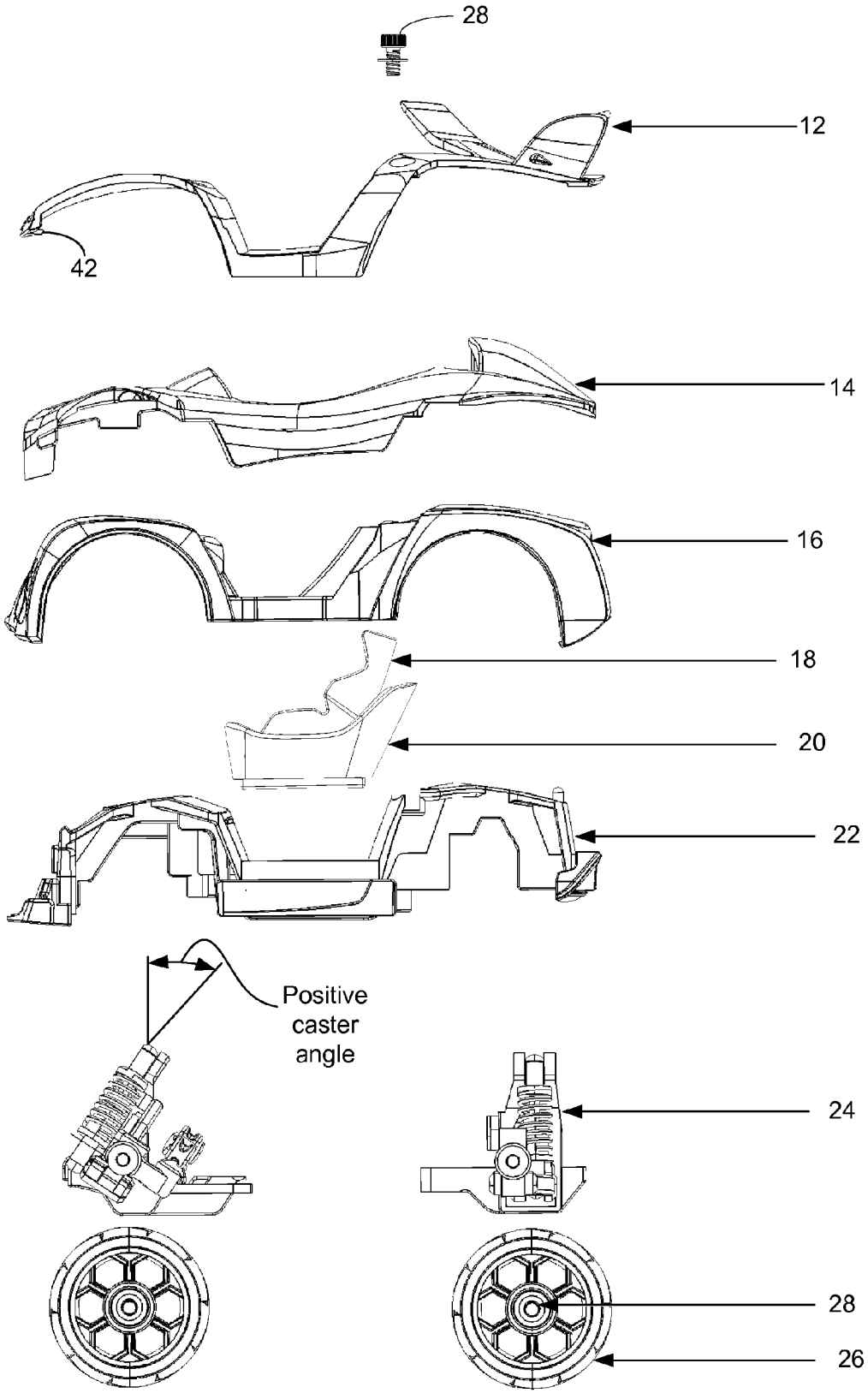
FIG. 9 is an exploded side view of the toy car of the embodiment of FIG. 1.

Turning now to FIGS. 7-9, it will be recognized that each of the body components may include a pair of spaced apart attachment holes, attachment holes 52 of fender 16 and attachment holes 54 of frame 12 illustrated in FIG. 7 and FIG. 8. It will be further recognized attachment holes 54 and attachment holes 52 are located in their respective external body components such that corresponding attachment holes of the external body components align with each other and with the fastener receiving holes 29 of the chassis 22 when the body components are positioned in an overlapped configuration as illustrated in the exploded view of FIG. 9. The alignment of attachment holes 52 and 54 and fastener receiving holes 29 allow coupling of the external body components to the chassis with a pair of body component fasteners 28G and 28H shown in FIG. 8. Each fastener is configured to extend through each of the attachment holes 52 and 54 of the body components into the corresponding fastener receiving holes 29 in the chassis 22 to secure the plurality of body components to one another and to the chassis 22. Briefly returning to FIG. 5, it will be appreciated that in some embodiments the chassis 22 may have corners rounded so as to avoid any injury to the child or adult user.

Figure 1:
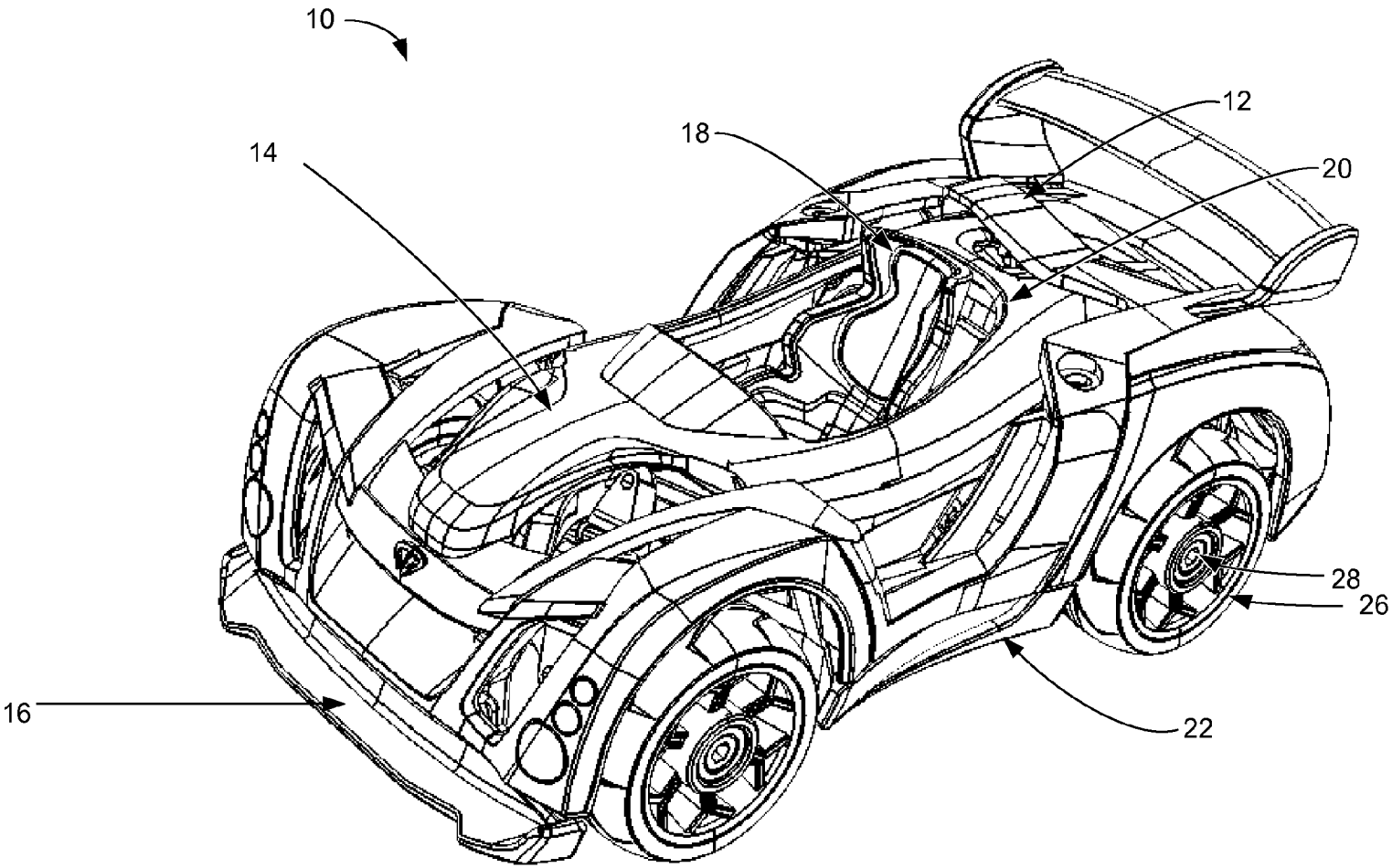
FIG. 1 is a perspective view of a toy car according to an embodiment of the present invention.
Figure 2:
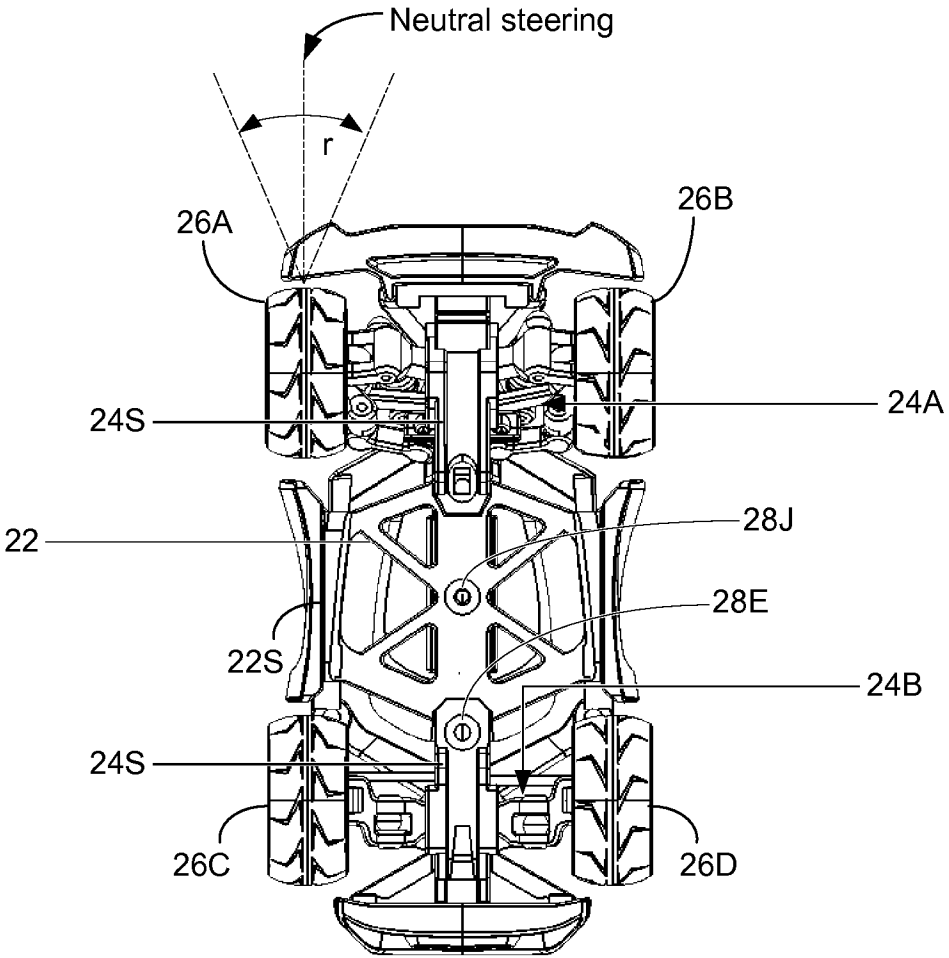
FIG. 2 is a bottom view of the toy car according to the embodiment of FIG. 1.

Turning now to FIG. 2, a bottom view of the toy car is shown. The underside of chassis 22 is configured in the shape of an X, such that the regions enclosed by the X are not solid, but voids. Additionally, chassis 22 may be configured with grind plates or wear plates. When the toy car is pressed down, the grind plates 22S contact the ground before the full travel of the suspension is reached or before the wheels contact an underside of the wheel wells. Additionally, front and rear suspension components 24A and 24B may be configured with grind plates 24S to protect the suspension components from mechanical damage from rough surfaces. The rear end of the chassis 22 may be configured with a license plate recess to include a license plate decal.

The toy car system 10 further includes a front suspension component 24A and a rear suspension component 24B, configured to respectively attach to an underside of the chassis 22. Additionally, the toy car system 10 includes a pair of front wheels 26A and 26B, and a pair of rear wheels 26C and 26D.

Figure 3A:
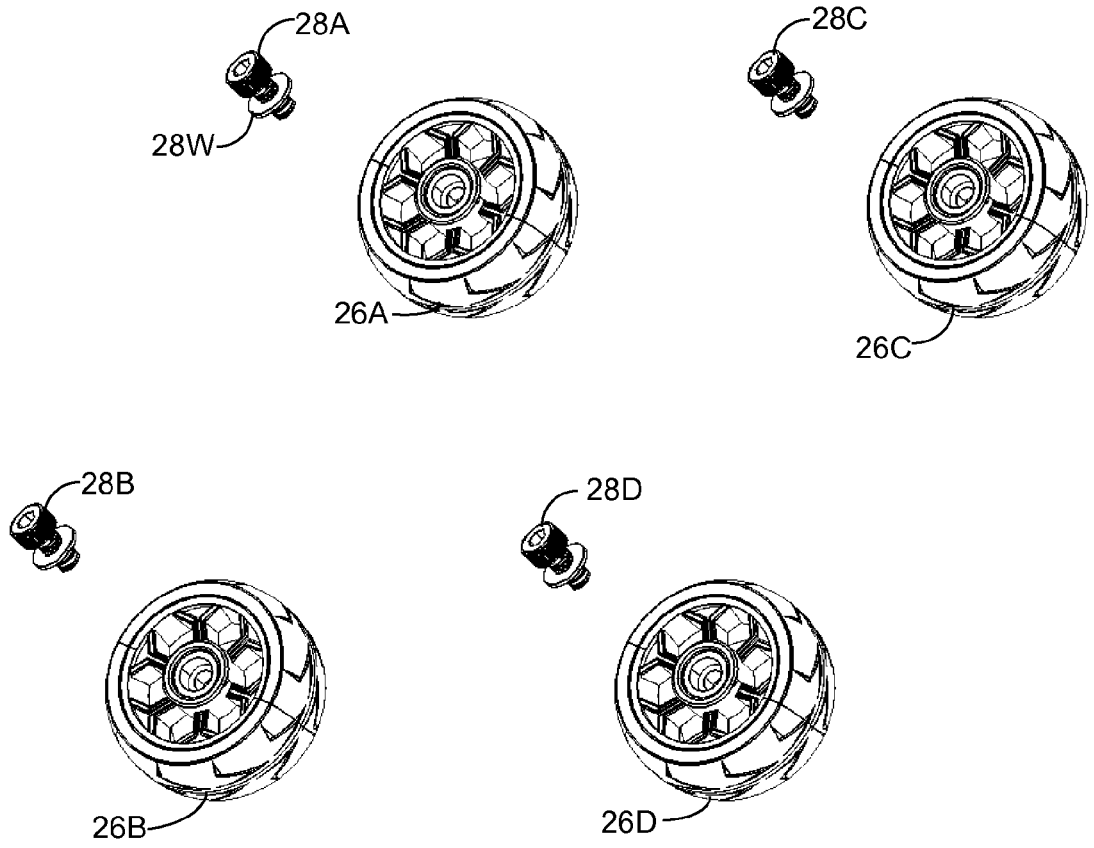
FIG. 3A is a perspective view of four wheels and fasteners of the toy car of the embodiment of FIG. 1.
Figure 3B:
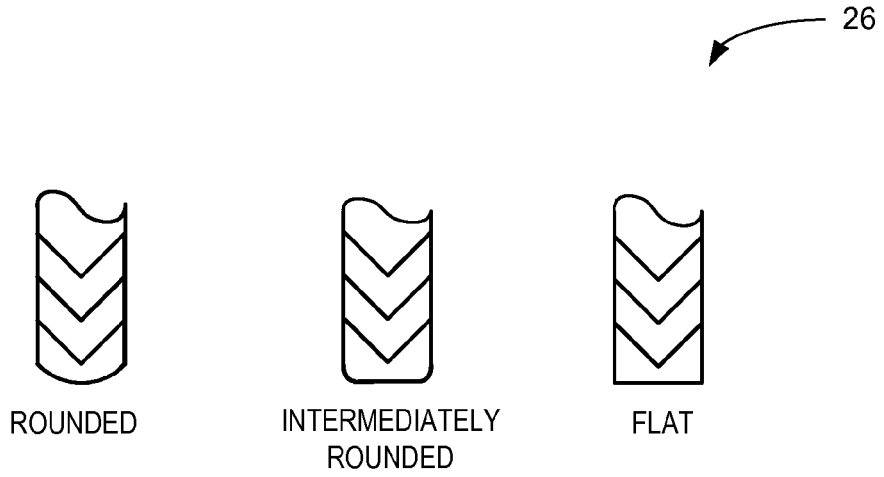
FIG. 3B is an illustration of tire profiles of the toy car of the embodiment of FIG. 1.

Turning now to FIG. 3A, each of the front pair and rear pair of wheels 26A-D may include a tire and hub assembly, and an associated fastener 28A-D. In some embodiments each wheel may be configured such that the respective fastener is retained in the wheel assembly. In this configuration, each wheel 26A, 26B, 26C, and 26D will be positioned between the head of their respective fastener 28 and a retaining ring 28W. Each front wheel 26A and 26B is attached to a corresponding right or left side of the front suspension component 24A by corresponding wheel fasteners 28A and 28B. Each rear wheel 26C and 26D is attached to corresponding right or left side of the rear suspension component 24B by corresponding wheel fasteners 28C and 28D. It will be appreciated that each of the front pair and rear pair of wheels may include a specific tire profile. FIG. 3B illustrates three non-limiting examples of tire profiles for a wheel 26: rounded, intermediately rounded, and flat.

Figure 14:
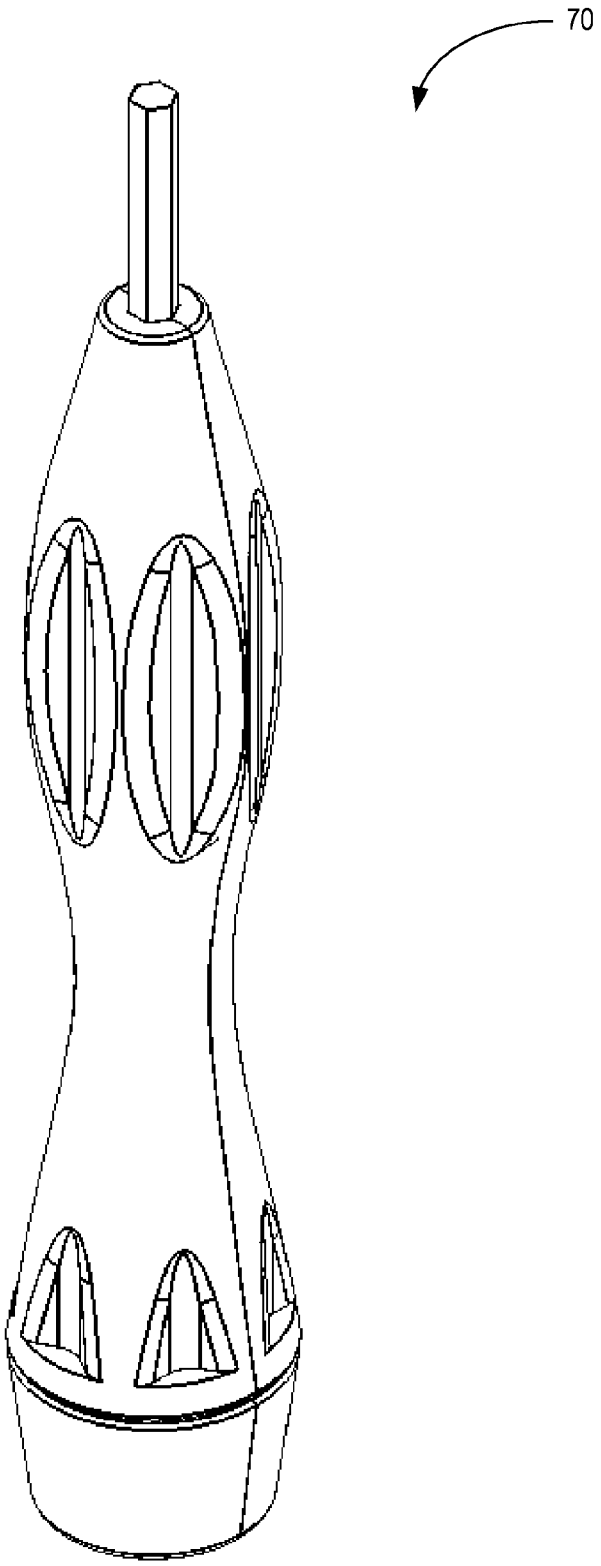
FIG. 14 illustrates an example tool for actuating fasteners of the toy car of FIG. 1.

Returning to FIG. 2, seat fastener 28J is also shown below. It will be appreciated that all the fasteners including the wheel fasteners 28A-D of FIG. 3A, the suspension fasteners 28E of FIGS. 4B and 28F of FIG. 2, the body component fasteners 28G and 28H shown in FIG. 8, and seat fastener 28J of FIG. 2 may have the same size, shape and configuration, which enables the fasteners to be actuatable by a same tool 70 illustrated in FIG. 14. In the depicted embodiment, fasteners 28A-28J are a plurality of externally threaded headed fasteners, having the same thread pitch, shaft diameter, and head configuration, which may be a hex head configuration. The head configuration is configured to be engaged by a single tool 70, such as a hex head wrench, for application of torque during installation and removal of the externally threaded headed fasteners. It will also be recognized that fasteners 28A-J may be designated as fastener 28 in some figures where a specific fastener number is not critical to the explanation of features illustrated in the figure. In other embodiments, fasteners 28A-28J may be configured differently. For example, fasteners 28 may be configured with different lengths, having different thread pitch, or may be retained within a specific component to facilitate specific design features. In these such embodiments, it will be recognized that all of the fasteners may not be interchangeable. In another embodiment, fasteners 28 may be locking pins. These locking pins may configured with a cap to allow actuation with the common tool and upon actuation, to lock into a respective receiving well to secure the component in place.

Turning now to FIGS. 4A and 4B, the front and rear suspension components of the toy car system will be discussed in further detail. The front and rear suspension components 24A and 24B include a suspension component body 27A and 27B respectively. Front suspension component body 27A provides a frame for attachment for various components such as springs 46, suspension arms 60, steering arms 58, steering linkage 25, and castered couplings 56 for securing the wheels to the suspension components. Front suspension component body 27A is configured such that the suspension component body projects aft along the centerline of the chassis and includes a slotted fastener receiving hole 23A allowing front suspension component 24A to be secured to the chassis. The longitudinal length of front suspension component body 27A is such that front suspension component may only be secured at the front of chassis 22. Rear suspension component body 27B lacks the longitudinal length to properly align the fastener receiving hole 23B with the fastener receiving hole for the front suspension component attachment within chassis 22. Thus, the front suspension component 24A and rear suspension component 24B are configured to only fit their respective position on chassis 22. Additionally, rear suspension component 24B does not include castered couplings, castered connections for the rear pair of wheels, or steering components. Rather, the rear wheels are each mounted with an axis of rotation that is perpendicular to the longitudinal axis of the toy car.

The front and rear suspension components 24A and 24B are configured to include springs 46 to absorb and cushion vertical forces applied to the toy car such as a vertical component of the motive force applied to the car or vertical forces generated by motion of the toy car over a rough surface. In one specific example, the springs may be configured with a spring stiffness specific to the design of the toy car. For example, a track car design may have stiffer springs 46. Stiffer springs 46 provide more resistance and less cushioning of any vertical forces applied to the toy car as a track car is less likely to encounter rough play surfaces. An additional example would be the use of less stiff springs 46 for an off road car design as the off road car may be required to cushion vertical forces due to play on rough surfaces. It will be appreciated that springs 46 may be of any suitable stiffness depending on the play surfaces anticipated for a given toy car design. In one such embodiment, the travel of springs 46 may be configured to be 0.250" for all car models. Of course, it will be appreciated that variations on these travel figures are possible, and a first preferred range may vary 10% and a second preferred range may vary 20% from these precise figures.

As shown in FIG. 2, the front suspension component 24A is further configured to provide maximum steering arc (r) of 25-30 degrees to the front wheels 26A and 26B, without the front wheels 26A and 26B colliding with neighboring components of the system 10. A preferred steering arc range may vary 10% from this precise figure, i.e., 22.5-33 degrees. As discussed above for FIG. 4B, each of the pair of front wheels is coupled to the chassis by a castered coupling 56 in the front suspension component 24A. Each castered coupling 56 is configured to provide each front wheel with a positive caster angle as illustrated in FIG. 9. This has the advantage of self-correcting steering due to the jacking forces created by the positive caster angle. Further, the front wheels are turnable and linked by steering linkage 25 configured to turn the front wheels in unison. Additionally, steering linkage 25 may limit the tendency of the front wheels to turn when the suspension springs are compressed. Thus steering linkage 25 may maintain the front wheels at a neutral steering angle as the toy car travels over a rough play surface.

It will be noted that although the toy car is turnable and the wheels turn in unison due to the steering linkage, the chassis does not include a steering wheel configured to steer the front wheels. Rather, the turning of the car is effected by the actuation of a user's finger in a finger receiving well of a finger engagement structure coupled to the chassis. The actuation of the user's finger imparts a motive force to the toy car at the finger engagement structure. The motive force may include lateral, longitudinal, and/or vertical component forces. For the purposes of discussion, a lateral component force will be a force along the lateral axis of the toy car, a longitudinal force will be along the longitudinal axis of the toy car, and a vertical component force will be along the vertical axis of the toy car. The chassis, front and rear suspension components, front pair of wheels, the rear pair of wheels, and the steering linkage are configured to cooperatively translate the motive force to motion of the toy car in a horizontal plane as discussed in further detail below.

Turning now to FIGS. 7 through 9, the external body components will be further discussed. The body components of system 10 further include a frame 12 of FIG. 8, a hood 14, and a fender 16, both illustrated in FIG. 7. As shown in the exploded view of FIG. 9, frame 12 is configured to overlap and secure both the hood 14 and the fender 16 to the chassis 22. Returning to FIG. 8, the frame 12 further comprises a front and/or rear pair of downwardly extending hooks 42 that extend through voids or into holes of the hood and fender to fix the lateral and longitudinal (X-Y) location of the frame, hood, and fender, relative to the chassis, when the fasteners 28G and 28H are secured through the frame, hood and fender into interior threaded receiving holes 29 in the chassis. The body components of system 10 are configured such that upon assembly, the body components provide a contour to allow the car to be grasped by opposing fingers of a user's hand. Thus the body contour is sized to be gripped by the hand of a user and allows a user to push and steer the toy car by applying a motive force at the sides of the body of the toy car.

Figure 10:
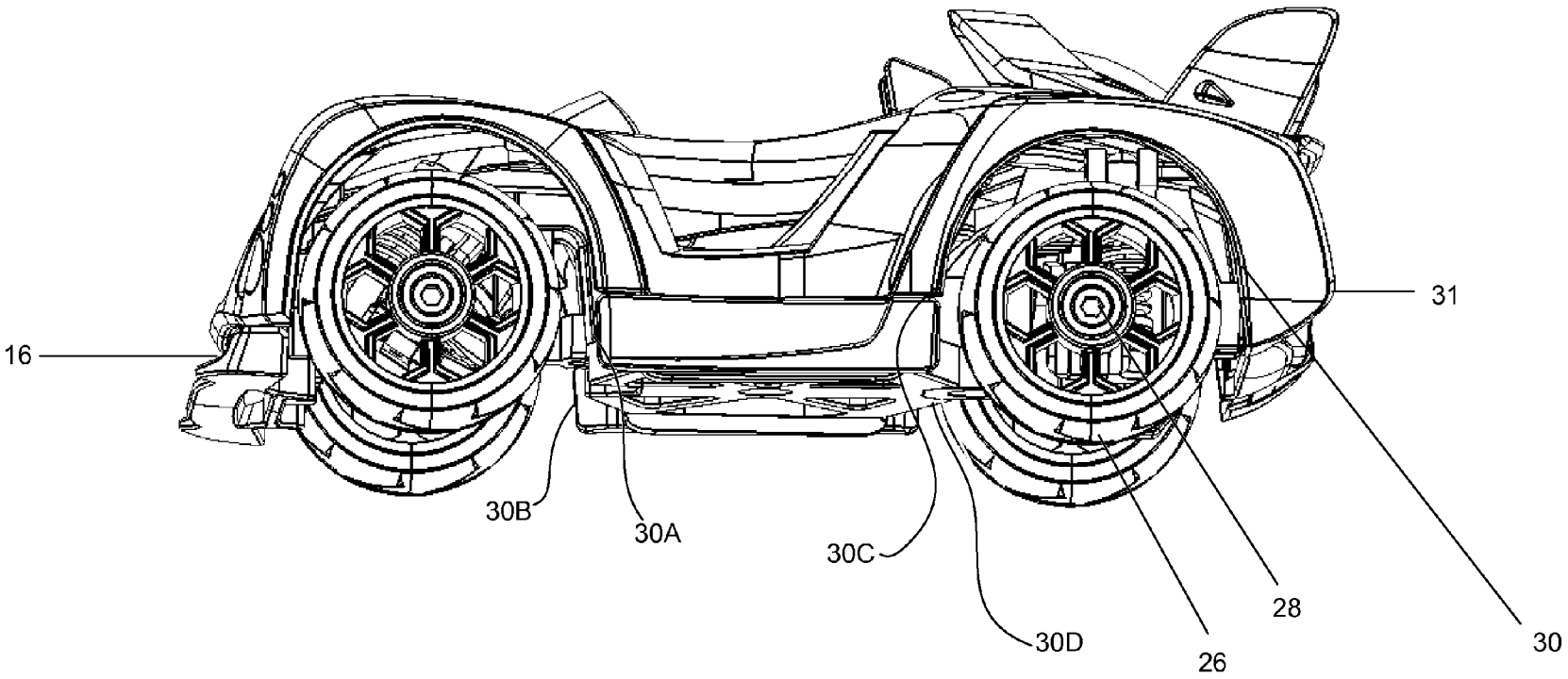
FIG. 10 is a side view of the toy car of the embodiment of FIG. 1.

Turning now to FIG. 10, fender 16 is further configured to accommodate wheels 26A-D in a pair of front wheel wells 30A, 30B and a pair of rear wheel wells 30-C, 30D. The front wheel wells and chassis are sized to prevent rubbing of the wheels on the wheel wells or chassis, such that the wheels do not rub any components when turned to the maximum steering angle in a rightward or leftward direction. The wheels also do not rub when the suspension is deflected to a maximum extent. Further, the wheels do not rub when the steering angle is maximum in either the rightward or leftward direction at the same time as the suspension is deflected to a maximum extent.

Figure 6:
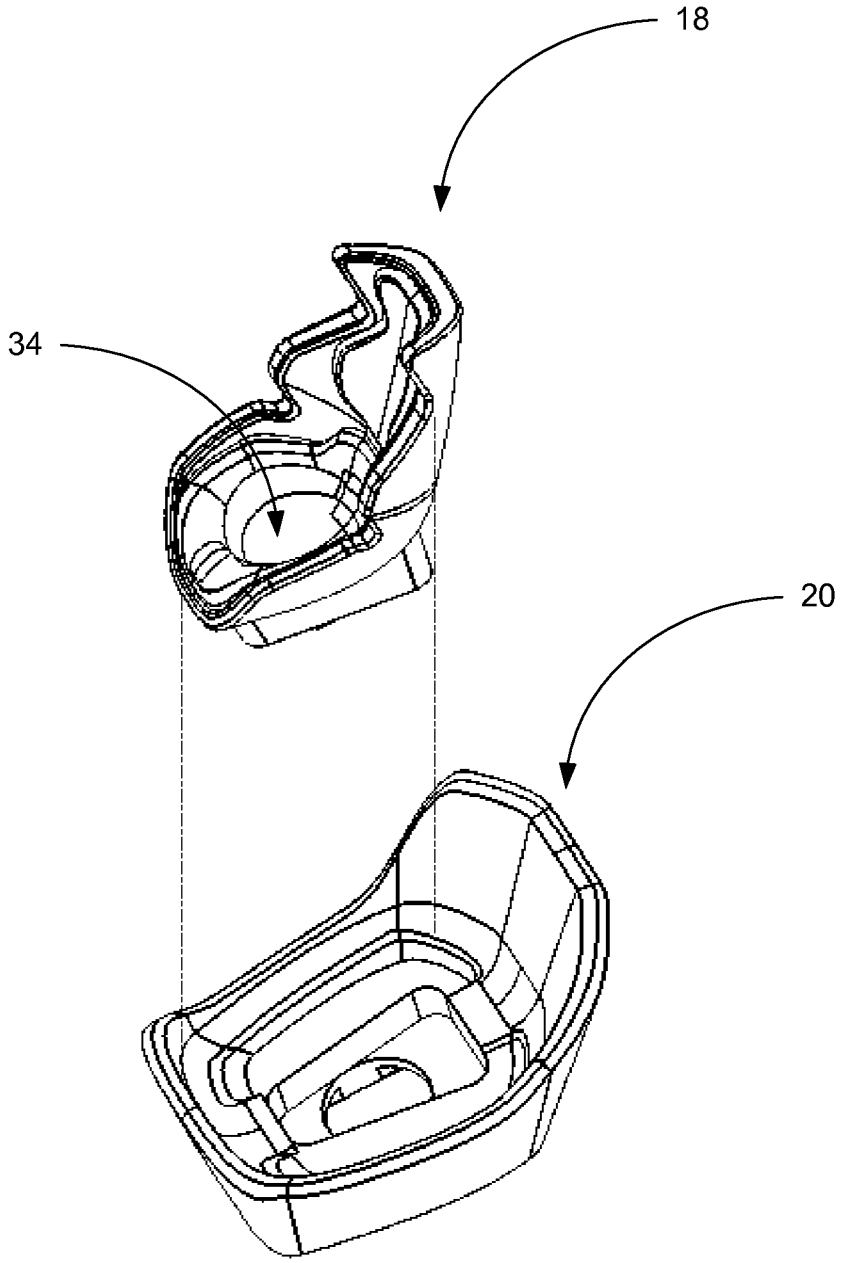
FIG. 6 is an exploded view of a seat and seat pan of the toy car of the embodiment of FIG. 1.

The finger engagement structure will now be discussed with reference to FIGS. 2, 5, 6, and 9. The toy car system 10 includes a seat 18 which can releasably attach to the chassis 22 at fastener receiving hole 19 (shown in FIG. 5) via a seat fastener 28J (shown in FIG. 2). As shown in FIGS. 6 and 9, the seat is configured to sandwich a seat pan 20 between the seat and chassis 22 when fastened by the seat fastener 28J, to thereby secure both the seat 18 and seat pan 20 to the chassis 22.

Returning to FIG. 6, the seat is further configured with a protuberance that extends down into a recess of the seat pan. The protuberance of the seat is further configured with a threaded hole to receive fastener 28J. The seat pan is configured with a pair of ridges on a bottom surface facing toward the chassis spaced such that a centerline chassis member fits snugly between the ridges. The seat pan also includes a hole in a bottom surface between the pair of ridges to allow fastener 28J to pass through to the seat. The seat 18 functions as a finger engagement structure to enable children to drive the toy car with a finger. The seat has a finger receiving well 34 formed therein to receive motive force from the digit of the user. Typically, at least a portion of the finger receiving well is configured to be substantially symmetrical about a substantially vertical axis. This enables relative rotational motion between the finger of the user and the finger receiving portion, for example, when the user is pushing and turning the toy car, without interference from other surfaces or structures.

As shown in FIG. 9, the finger receiving well 34 is positioned in a central region of the chassis of the toy car, longitudinally and laterally intermediate the front and rear wheels, as viewed from above. The finger receiving well is thus typically substantially centered in a lateral (i.e., right-left) dimension between right side wheels and left side wheels of the toy car, and substantially centered in a longitudinal (i.e., front-rear) dimension relative to the front and rear wheels. The finger receiving well may be positioned at a height that is at or below a top side of the chassis, at a minimum, to provide the user better driving feel. In some embodiments, the finger receiving well may be positioned at a height that is at or below a top side of a largest diameter wheel among the front and rear wheels, and also that is at or above a height of the axis of rotation of a lowest one of the front and rear wheels.

The finger receiving well 34 may receive a force from a finger of a user having a vertical component, a horizontal component along the longitudinal axis of the toy car, and or a rotational component. The force is translated into motion of the toy car cooperatively by the finger receiving well, chassis, front and rear suspension, and steering linkage. For example, a user may provide a motive force whose component forces include a vertical component force downward and a longitudinal force forward at the finger receiving well. The motive force is transferred to the chassis which distributes the force to the front and rear suspension components. The vertical component may be absorbed in part or in whole by springs 46. The remaining horizontal component may then be translated to the wheels resulting in rotation of the wheels and a forward motion of the toy car. Another example may include a lateral component force to the motive force applied to the finger receiving well. In this case, the lateral component force is indicative of an intent to turn the car. In this instance, the castered front suspension and steering linkage translate the lateral component of the motive force into a steering force on the front wheels resulting in a non-zero steering angle (turning of a longitudinal centerline of the wheels away from a zero or neutral steering angle shown in FIG. 2). Steering linkage 25 allows the tires to turn in unison and in a limited steering angle proportional to the lateral component force applied to the toy car resulting in a smooth turning of the toy car. The front wheels may maintain the radius of the turn until the lateral component of the applied force is terminated. Upon termination of the lateral component force of the motive force, the positive caster angle of front suspension 24A providing a force upon each of the front wheels toward a neutral steering angle.

In the alternative play mode where the force is applied at the body contour, the chassis, front and rear suspensions, and wheels function analogously to translate a multi-component motive force into motion of the toy car.

It should be easily apparent from the above description that a user can readily assemble the various component parts of the toy car described herein. First and as shown if FIGS. 1-9, the user may assemble the front and rear suspension components 24A, 24B to the chassis 22 using the fasteners 28E-28F, and then attach each of the wheels 26A-26D to the suspension components 24A, 24B, via the fasteners 28A-D. The user may secure the frame 12 to the chassis 22, sandwiching the hood 14 and fender 16, by securing fasteners 28G and 28H in receiving holes 29, while aligning the hooks 42 such that the frame, hood, and fender are securely coupled to the chassis. Finally, the user may attach the seat 18 to the chassis via fastener 28J, sandwiching seat pan 20. The user may then drive and turn the car by pressing a digit on the finger-receiving well of the finger engagement structure and imparting a motive force therein.

Although only two fasteners and fastener receiving holes 29 for securing the frame to the chassis are shown the Figures, additional fasteners and fastener receiving holes 29 may be included to secure the body components to the chassis. It will also be appreciated that alternative configurations of the fasteners and fastener receiving holes may be applied.

As a further play option for users that purchase more than one of the toy cars in the product family, the user may interchange components between the street car, track car and dirt car to create custom toy cars having unique appearance and functionality, as desired. Thus, it is also contemplated that a toy car system is provided that includes a plurality of toy cars having interchangeable but differently shaped components having internally threaded regions positioned at standardized locations, the differently shaped components being connectable by externally threaded headed fasteners secured in the internally threaded regions. FIGS. 11 and 12 show an orthogonal and exploded side view of an alternative toy car system 10T. Toy car system 10T represents a toy car with an off road design including a chassis 22T, frame 12T, a hood 14T, a fender 16T, and wheels 26T. It will be appreciated that the components of toy car system 10T are shaped in an off road design and that other toy car designs will result in differently shaped but functionally analogous components within their respective toy car systems. The externally threaded headed fasteners 28 typically have the same thread pitch, shaft diameter and head configuration for all toy car designs and toy car systems.

As discussed above, the functionally analogous components of the different toy car systems may be interchanged between the toy car systems providing the user with the capability of assembling hybrid toy cars. The wheels of any of the toy cars are attachable to the suspension of the other toy cars, and the suspension of any of the toy cars are attachable to the chassis of any of the other toy cars, and the body component of any of the toy cars are attachable to the chassis of any of the other toy cars, via the externally threaded headed fasteners. Furthermore, front suspension 24A and 24B are configured such that the front and rear suspensions may not be inadvertently switched. Further, front suspension 24A includes a slotted attachment hole 23A which allows fastener 28E to slide along the longitudinal axis of the front suspension and the chassis of the toy car to accommodate slight differences in the fastener receiving hole in the chassis of the various toy car systems. By interchanging these components, a myriad of possible configurations may be assembled by the user.

FIG. 13 is an exploded side view of one such possible hybrid configuration of a toy car assembled from the components of toy car systems 10 and 10T. In this specific example, the toy car is assembled using the frame 12T, hood 14T, suspension components 24T, tires 26T from toy car system 10T and fender 16, seat 18, seat pan 20, and chassis 22 from toy car system 10. It will be appreciated that this is a non-limiting example of one potential configuration and the other configuration integrating the components of toy car systems 10 and 10T, and those including components of other toy car systems are anticipated.

Other aspects of the invention are described in the following claims.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A toy car, wherein the toy car is scaled to receive a force from a user's hand, the toy car comprising:

a chassis;

a finger engagement structure coupled to the chassis;

a pair of rear wheels rotatably coupled to the chassis;

a pair of front wheels rotatably coupled-to the chassis via a castered coupling, the front wheels being turnable and linked by a steering linkage and steering arms configured such that the front wheels turn in unison in response to a motive force applied to the toy car; and a front suspension component including springs coupled to the steering linkage through suspension arms by pivots, the pivots arranged such that during compression of the springs the steering linkage and suspension arms limit a tendency of the pair of front wheels to turn;

wherein the chassis, the pair of front wheels, the pair of rear wheels, the steering arms, and the steering linkage are configured to cooperatively translate the motive force applied at the finger engagement structure to motion of the toy car; and wherein the castered coupling is configured to provide each front wheel with a positive caster angle, the positive caster angle providing a force on each of the front wheels toward a neutral steering angle.

2. The toy car of claim 1, wherein the finger engagement structure includes a finger receiving well.

3. The toy car of claim 2, wherein the finger receiving well is positioned in a central region of the chassis of the toy car, longitudinally and laterally intermediate the front and rear wheels.

4. The toy car of claim 3, wherein the finger receiving well is substantially centered in a lateral dimension between right side wheels and left side wheels of the toy car.

5. The toy car of claim 3, wherein the finger receiving well is substantially centered in a longitudinal dimension relative to the front and rear wheels.

6. The toy car of claim 3, wherein the finger receiving well is positioned at a height that is at or below a top side of the chassis.

7. The toy car of claim 3, wherein the finger receiving well is positioned at a height that is at or below a top side of a largest diameter wheel among the front and rear wheels.

8. The toy car of claim 7, wherein the finger receiving well is positioned at a height that is at or above a height of the axis of rotation of a lowest one of the front and rear wheels.

9. The toy car of claim 2, wherein at least a portion of the finger receiving well is configured to be symmetrical about a substantially vertical axis.

10. The toy car of claim 2, wherein the finger engagement structure is formed in the shape of a seat mounted in a central region of the chassis as viewed from above.

11. The toy car of claim 1, wherein the chassis does not include a steering wheel configured to steer the front wheels, and wherein the turning of the car is effected by the actuation of a user's finger in a finger receiving well of a finger engagement structure coupled to the chassis.

12. The toy car of claim 1, wherein the chassis and a plurality of external body components form a body contour, the body contour providing a surface to grip the toy car with opposing fingers.

13. The toy car of claim 12, wherein the body contour is substantially centered in a longitudinal dimension relative to the front and rear wheels.

14. The toy car of claim 1, wherein the toy car includes a body shaped in the form of one of a street car, track car, or dirt car.

15. The toy car of claim 14, further comprising a rear suspension component, wherein the rear suspension component include springs configured to absorb a vertical force applied to the toy car.

16. The toy car of claim 1, wherein the front suspension component is further configured to provide maximum turning radius in a range from 25-30 degrees to the front wheels.

17. The toy car of claim 14, wherein the pair of front wheels and the pair of rear wheels each include a tire, wherein a profile of the tire is configured to be one of rounded, intermediately rounded, or flat.

18. A toy car, comprising:

a chassis;

a pair of rear wheels rotatably coupled to the chassis;

a pair of front wheels coupled via a castered coupling to the chassis, the front wheels being turnable and linked by a steering linkage and steering arms configured such that the front wheels turn in unison in response to a motive force applied to the toy car;

a front suspension component including springs, wherein the springs are configured to cushion a vertical force applied to the toy car and wherein the front suspension component is further configured to provide a maximum turning radius in a range of 25-30 degrees to the front wheels and wherein the springs are coupled to the steering linkage through suspension arms by pivots, the pivots arranged such that during compression of the springs the steering linkage and suspension arms limit a tendency of the pair of front wheels to turn;

a rear suspension component including springs wherein the springs are configured to cushion a vertical force applied to the toy car;

a removable seat and seat pan coupled to the chassis, the removable seat configured to receive a finger and receive the motive force applied at the seat of the toy car; and wherein the chassis, the front suspension, rear suspension, the pair of front wheels, the pair of rear wheels, the steering arms, and the steering linkage are configured to cooperatively translate the motive force applied to the seat to motion of the toy car in a horizontal plane; and wherein the castered coupling is configured to provide each front wheel with a positive caster angle, the positive caster angle providing a force on each of the front wheels toward a neutral steering angle.

19. A toy car, comprising:

a chassis;

a pair of rear wheels rotatably coupled to the chassis;

a pair of front wheels, each of the pair of front wheels coupled via a castered coupling to the chassis, the front wheels being turnable and linked by a steering linkage and steering arms configured such that the front wheels turn in unison in response to a motive force applied to the toy car;

a front suspension component including springs, wherein the springs are configured to cushion a vertical force applied to the toy car, wherein the front suspension component is further configured to provide a maximum turning radius in a range of 25-30 degrees to the front wheels and wherein the springs are coupled to the steering linkage through suspension arms by pivots, the pivots arranged such that during compression of the springs the steering linkage and suspension arms limit a tendency of the pair of front wheels to turn;

a rear suspension component including springs wherein the springs are configured to cushion a vertical force applied to the toy car;

a removable seat and seat pan coupled to the chassis, the removable seat configured to receive a finger and translate the motive force applied at the seat to motion of the toy car;

a plurality of external body components, wherein the chassis and the plurality of external body components form a body contour centered longitudinally between the front and rear wheels, the body contour sized to be gripped by a hand of a user and providing a surface to grip the toy car with opposing fingers; and wherein the chassis, the front suspension, rear suspension, the pair of front wheels, the pair of rear wheels, the steering arms, and the steering linkage are configured to cooperatively translate the motive force applied to the body contour to motion of the toy car in a horizontal plane; and wherein the castered coupling is configured to provide each front wheel with a positive caster angle, the positive caster angle providing a force on each of the front wheels toward a neutral steering angle.

* * * * *